US007681326B2

(12) United States Patent
Sugawara et al.

(10) Patent No.: US 7,681,326 B2
(45) Date of Patent: Mar. 23, 2010

(54) ALL WEATHER PASSIVE-TYPE SOLAR OGAKO DRYING HOUSE

(75) Inventors: Tomoyoshi Sugawara, Hokkaido (JP); Kimio Kanayama, Hokkaido (JP); Shoshichi Sotoda, Hokkaido (JP); Kazuhiko Sotoda, Hokkaido (JP); Hiromu Baba, Hokkaido (JP); Hidehiko Seto, Hokkaido (JP); Katsuhiko Shibuya, Hokkaido (JP); Toshiyuki Tachi, Hokkaido (JP); Shinya Koga, Hokkaido (JP); Masahiro Nakajima, Hokkaido (JP); Akira Yaegashi, Hokkaido (JP); Zenbei Komiyama, Hokkaido (JP)

(73) Assignee: Marusho-Giken Co., Ltd., Hokkaido (JP)

( * ) Notice: Subject to any disclaimer, the term of this patent is extended or adjusted under 35 U.S.C. 154(b) by 394 days.

(21) Appl. No.: 11/733,529

(22) Filed: Apr. 10, 2007

(65) Prior Publication Data

US 2007/0294956 A1 Dec. 27, 2007

(30) Foreign Application Priority Data

Jun. 25, 2006 (JP) ..... 2006-174673
Jun. 26, 2006 (JP) ..... 2006-175725

(51) Int. Cl.
*F26B 19/00* (2006.01)

(52) U.S. Cl. ..... 34/93; 34/72; 34/207; 34/203; 34/396; 34/512; 34/522; 198/539; 198/560

(58) Field of Classification Search ..... 34/93, 34/522, 512, 396, 72, 202, 207, 208, 266, 34/218, 203, 205; 198/534, 539, 560
See application file for complete search history.

(56) References Cited

U.S. PATENT DOCUMENTS 1,491,489 A * 4/1924 Mueller ..... 198/534
4,069,593 A * 1/1978 Huang ..... 34/93
4,387,533 A * 6/1983 Green et al. ..... 47/17

FOREIGN PATENT DOCUMENTS

| | | |
|---|---|---|
| JP | 50-156750 | 12/1975 |
| JP | 5-185098 | 7/1993 |
| JP | 8-042970 | 2/1996 |
| JP | 2001-293294 | 10/2001 |
| JP | 2002-147953 | 5/2002 |
| JP | 2005-164171 | 6/2005 |

OTHER PUBLICATIONS

English Language Abstract of JP 5-185098.

(Continued)

*Primary Examiner*—Kenneth B Rinehart
*Assistant Examiner*—Corey Hall
(74) *Attorney, Agent, or Firm*—Greenblum & Bernstein P.L.C.

(57) ABSTRACT

In application of a green-house effect, under such a concept as to collect solar energy passively into the house and to exhaust moist air passively from the house, an all weather passive-type solar Ogako drying house which is available for all day through a year was made up improving an agricultural vinyl-house in which Ogako is dried continuously during carriage on the belt conveyors due to solar energy and auxiliary heat, and then moist air yielded when drying Ogako is exhausted through an insulated cylinder. In this case, Ogako means sawdust or tipped small particles of wood which is raw material in order to produce a woody pellet fuel.

3 Claims, 7 Drawing Sheets

OTHER PUBLICATIONS

English Language Abstract of JP 50-156750.
English Language Abstract of JP 8-042970.
English Language Abstract of JP 2001-293294.
English Language Abstract of JP 2002-147953.
English Language Abstract of JP 2005-164171.
U.S. Appl. No. 11/733,505 to Sugawara et al., filed Apr. 10, 2007.

* cited by examiner (a)

(b)

(a)

(b)

(a)

(b)

(a)

(b)

ALL WEATHER PASSIVE-TYPE SOLAR OGAKO DRYING HOUSE

BACKGROUND OF THE INVENTION

In this time when progressing an earth warming, in order to make a woody pellet fuel from Ogako, the moisture content of Ogako affects the quality of the product of which, therefore the drying of Ogako is important process. However, a lot of thermal energy is necessary to dry the Ogako, and fossil oil has to be greatly consumed as energy source. From a view point of energy saving and fossil oil free techniques, all weather passive-type solar Ogako drying method is seriously effective and useful.

Two types of Ogako dryer are known.

1) Rotary kiln-type Ogako dryer which is a well known batch system, peculiarities of which are as follows:

a. an expensive facility, b. being fire dangerous under bridge flame (high temperature), c. too much consumption of fuel and electric power, d. to be suitable for large scale facility, but e. uniform quality of the production.

2) Air absorption-type Ogako dryer which is another well known batch system, peculiarities of which are as follows:

a. an expensive facility, b. yielding of Ogako dust, c. too much consumption of fuel and electric power, d. to be suitable for large scale facility, but e. uniform quality of the production.

3) Some solar dryer by which high moisture substances such as sullage and bean-curd refuse can be dried cheaply by evaporation due to solar thermal energy and so as out of auxiliary heat, and dehydration due to capillarity phenomena of fibrous belt of the conveyor has been known (Japanese Published Unexamined Patent Application No. 05-185098).

SUMMARY OF THE INVENTION

The object of the invention related to an all weather passive-type solar Ogako drying house H, improving an agricultural vinyl-house, is to dry moist Ogako owing to solar energy from solar radiation R permeated a double transparent film 1 into the house and artificial heat from a top radiation panel heated with high temperature steam and a floor heater heated with hot water supplied by an auxiliary boiler, in the house H Ogako on the belt conveyors 4, 5 moving with slow speed is dried continuously due to solar energy in daytime but auxiliary heat in night, and moist air yielded when drying Ogako is exhausted through an insulated cylinder 13 with take-out damper duct 12' caused by the draft force, and also outside air is taken into the house through the take-in damper ducts 12 and the shutter windows 14 to satisfy shortage of air inside the house.

The first aspect of the invention is an all weather passive-type solar Ogako drying house H improving an agricultural vinyl-house, shaped as a Quonset hut comprises of:

a roof and walls of the house H made of a double transparent film 1 and a shading sheet 1', a floor 2 of the house H made of concrete, a floor heater 3 molded in floor 2.

two lines of belt conveyors 4, 5 installed in parallel each other along depth direction, one of which is a go-ahead conveyor 4 and the other is a go-back conveyor 5, a turn-back table 6 connecting both the conveyors 4, 5 is set up at the start point of the go-back conveyor 5, a supply hopper 7 set on over the go-ahead conveyor 4 at start point, the west side end of the house H, a receive hopper 8 set on under the end of go-back conveyor 5 and lower level than that of the supply hopper 7 at end point, the east west side end of the house H, a saucer-shoot 9 set on the end point of the go-ahead conveyor 4 to receive Ogako from the conveyors 4, a saucer-plate 9' set on the start point of the go-back conveyor 5 to transfer Ogako into the go-back conveyor 5, a scraper 6' on the turn-back table 6 to rake off Ogako from the turn-back table 6 to saucer-plate 9' set up at the start point of the go-back conveyor 5, a fixed-type top radiation panel 10 and a slide-type top radiation panel 10', which is able to slide to north side from south side of the house, hung on over the go-ahead and go-back conveyors 4, 5 respectively, two insulated cylinders 13,13 equipped with take-out damper duct 12' settled in vertical north surface side of the house H in which draft force is available.

According to the first aspect of the invention, in daytime, a supply hopper 7 is placed at start point of a go-ahead conveyor 4 and a receive hopper 8 is placed at end point of a go-back conveyor 5, and raw Ogako is fed on the go-ahead conveyor 4 moving slow with uniform thickness from an outlet of the supply hopper 7, 50 that raw Ogako is dried absorbing direct solar radiation R transmitted through a double transparent film 1 by means of sliding the top radiation panel 10' in north side of the house.

A saucer shoot 9 is set on the end point of the go-ahead conveyor 4, and Ogako is transferred into a turn-back table 6 after received in the saucer shoot 9 once. The turn-back table 6 which is rotated slowly counterclockwise receives as half dried Ogako from the go-ahead conveyor 4, then half dried Ogako is raked off by a scraper 6' to a saucer plate 9' and fed into the go-back conveyor 5 with uniform thickness again. The half-dried Ogako is fully dried due to radiation from a fixed-type top radiation panel 10 hung over the go-back conveyor 5 and recovered into a receive hopper 8 at the end point of which as fully dried Ogako.

Ogako can be transferred from the go-ahead conveyor 4 to the go-back conveyor 5 due to its own gravity and raking off by the scraper 6' through rotation of the turn-back table 6, during the transference and the rotation the mixing effect of Ogako is expected.

While in night and on heavy cloudy day, inside air is warmed up due to radiation and convection by means of the top radiation panels 10, 10' and a floor heater 3 molded in the concrete floor 2 preferably heated with an auxiliary boiler (not shown in Figs), and then raw Ogako on the go-ahead conveyor 4 is dried by means of a sliding-type top radiation panel 10' pulled back in proper position of south side over which, and also half dried Ogako on a go-back conveyor 5 is dried by means of a fixed-type top radiation panel 10 over which by supplying high temperature steam (150° C.) from an auxiliary boiler respectively.

And moist air yielded when drying Ogako is exhausted through an insulated cylinder 13 equipped with take-out damper duct 12' caused by the draft force, and also outside air is taken into the house through the take-in damper ducts 12 to satisfy shortage of air inside the house.

Second aspect of all weather passive-type solar drying house H according to the first aspect of the invention, the shading sheet 1' is opened to collect the solar energy in daytime and is closed to obstruct heat loss in night by means of windlass which is spread up inside the double transparent film 1 of the house.

According to the second aspect of the invention, the drying capacity and the drying operational rate of the house H can be raised depending on that the shading sheet 1' is opened in daytime and closed in night.

An open-close-type shading sheet 1' which is spread inside the double transparent film 1 of the house is opened to collect the solar energy in daytime and closed to obstruct heat loss in night by means of a rolling windlass 1", and also a fixed-type top radiation panel 10 use for all days is hung over a go-back conveyor 5 in north side of the house, and a slide-type top radiation panel 10' use for night or heavy cloudy day is hung over of a go-ahead conveyor 4 in south side of the house.

Third aspect of all weather passive-type solar Ogako drying house H according to the first aspect of the invention the rotational mixing scrapers 20 held freely by two bearings 28 through a rotational axis 29 which are provided on both sides of the go-ahead conveyor and the go-back conveyor, are set on bridging the side frame of the go-ahead conveyor 4 and go-back conveyor 5 respectively.

According to the third aspect of the invention, when Ogako is transferred on the go-ahead conveyor 4 and go-back conveyor 5, the rotational mixing scraper 20 can be attached on as two sets an about 10 m conveyor each, and rotated oppositely to progressing direction of the go-ahead conveyor 4 and go-back conveyor 5, so that mixing and drying of Ogako can be more accelerated.

Dimension of all weather passive-type solar Ogako drying house H is 4.5~5.0 m width, 15~16 m length, and 3.0~3.5 m height in size, which is the most same size dimension as the preceding fully passive-type solar Ogako drying house H, however, the fuel consumption becomes twice because of doubled top radiation panels, nevertheless the electric power consumption don't increase and so this means an energy saving-type less than 1000 W which is summarized as:

(1) The drying house is available to for all seasons, besides of low initial cost and rapid repayable.

(2) There are no fire sources inside the facility, and so this means out of fire's danger.

(3) In addition to the above, this drying house H has the mostly same peculiarities as the preceding fully passive-type solar Ogako drying house.

BRIEF DESCRIPTION OF THE DRAWINGS

FIG. 6(*b*) Side view of the turn-back table

FIG. 7(*b*) Plan view of the rotational mixing scraper

BEST MODE OF THE EMBODIMENT

Figure 1:
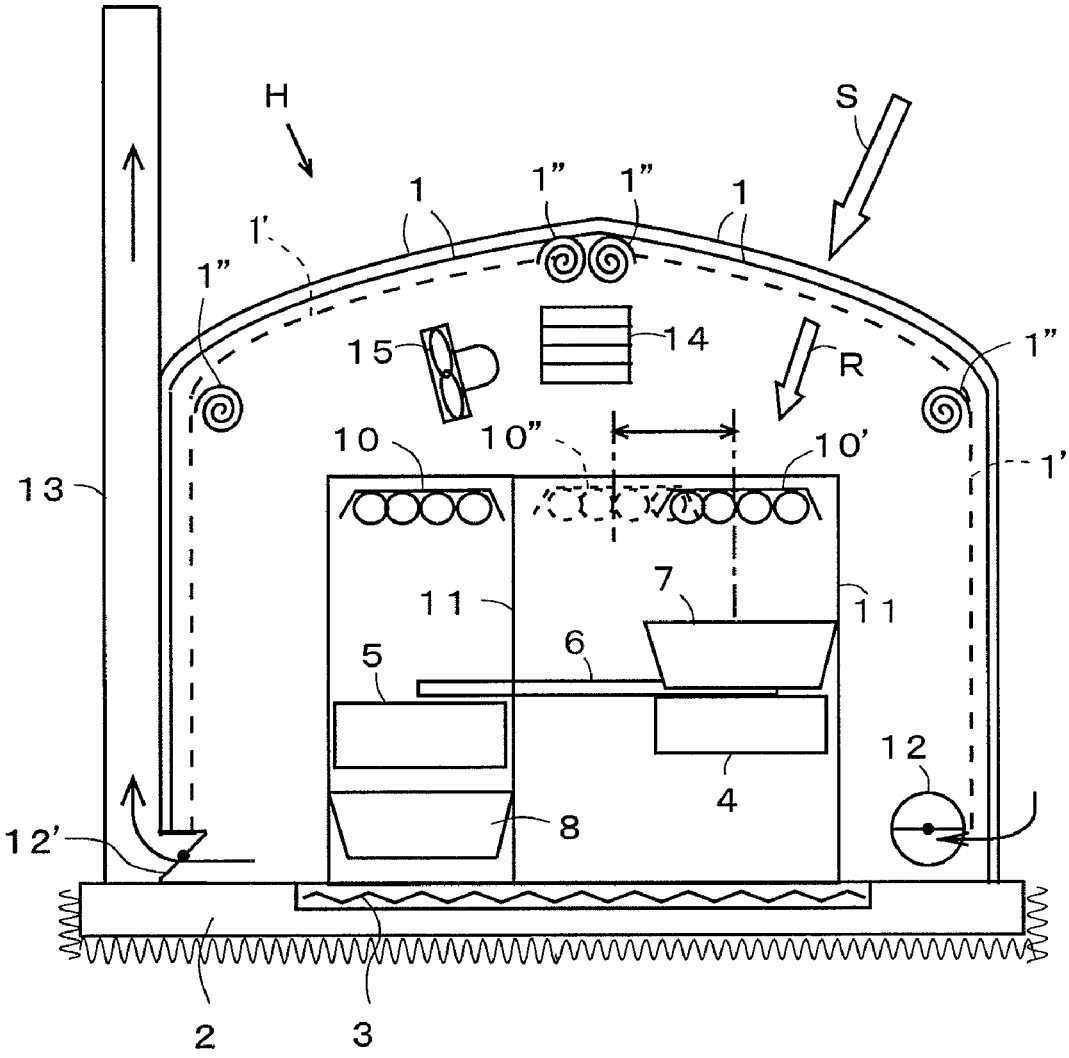
FIG. 1 is front view of all weather passive-type solar Ogako drying house
Figure 2:
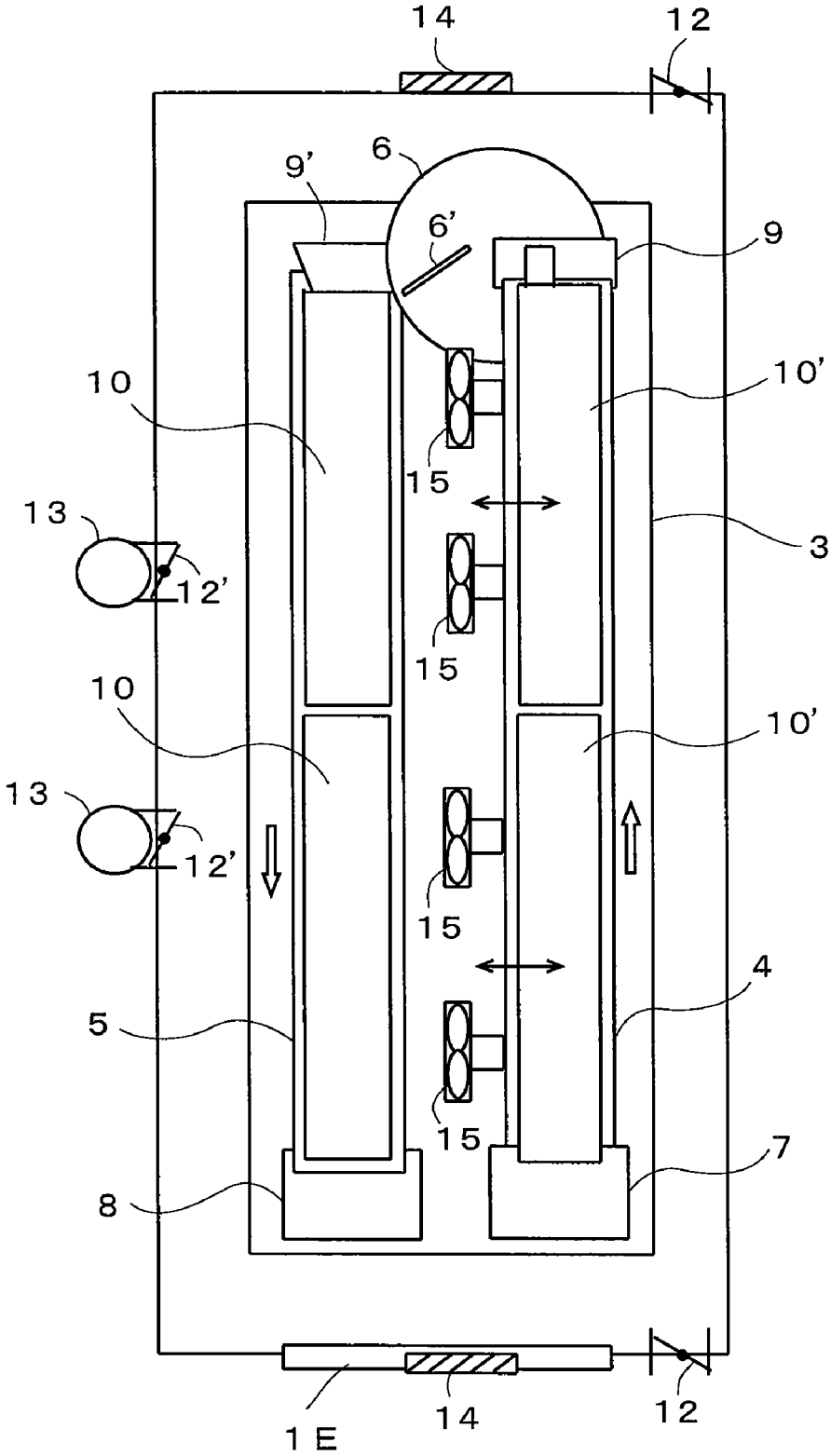
FIG. 2 is plan view of all weather passive-type solar Ogako drying house

According to the attached Figs, an executive example can be explained as follows:

As shown in front view of FIG. 1 and plan view of FIG. 2, the proper body of the drying house H like a Quonset hut constructed on a concrete floor 2 in depth direction, and covered with a double transparent film 1 and an open-close-type shading sheet 1' inside the house. Solar radiation S permeates the double transparent film 1 and enters fully into the house H in daytime, while in night, the inside of roof and south surfaces of the house H is shut down with the open-close-type shading sheet 1' to obstruct heat loss from the house. In this case, to raise up the green-house effect and the working performance, the double transparent film 1 may be changed to a triple transparent film.

The double transparent film 1 consists of the first layer film (trade name/F CLEAN NATURAL RAY, thickness 60μ, material/fluorine resin series, made by ASAHI GLASS GREEN-TECH Corporation), second layer film (trade name/ACHILLES SOLAR CLEAN-IRODORI, thickness/0.13 mm, material/poly-vinyl chloride series, made by Achilles Corporation) in the embodiment. Any kinds of transparent film may be used as the double transparent film 1.

The shading sheet 1' is a breathable plain sheet woven of a reed-shape film laminated of poly-vinyl chloride (black) and aluminum foil (trade name/DAIONET, trade number/No. 1212 (black), made by Dio Chemicals Corporation) in the embodiment.

The insulated cylinder 13 with take-out damper duct 12' which exhaust passively moist air inside the house is settled outside north surface of the house H, take-in damper ducts 12 and shutter windows 14 are set up one by one on the west surface and the east surface each, besides the entrance 1E is provided on the west surface of the house for carrying in and out the Ogako.

Two belt conveyors of a go-ahead conveyor 4 and a go-back conveyor 5 of 10 m length and 900 m width each, are installed inside the house H, and both of a slide-type top radiation panel 10' and a fixed-type top radiation panel 10 heated with steam in high temperature of 150° C. are set over the go-ahead conveyor 154 and the go-back conveyor 5 in each.

Concerning the operation method on the top radiation panels 10, 10', the fixed-type top radiation panel 10 which is always hung on about 600 mm over the go-back conveyor 5 is available in daytime, while the slide-type top radiation panel 10' which is also hung on about 600 mm over the go-ahead conveyor 4 can be slid in north-south direction being available in night or heavy cloud day too. In daytime, the slide-type top radiation panel 10' can be slid until 600 mm (max) in north side as a scheme 10", so that transmitted solar radiation R can be directly incident on the go-ahead conveyor 4 without any shading. Both of the belt-conveyors 4, 5 move with slow speed of 10 m/h (=0.167 m/min).

Though in substitution for the slide-type top radiation panel 10' a day light reflection plate can be provided, the drying effect by which is less performed than using the slide-type top radiation panel 10'.

Figure 3:
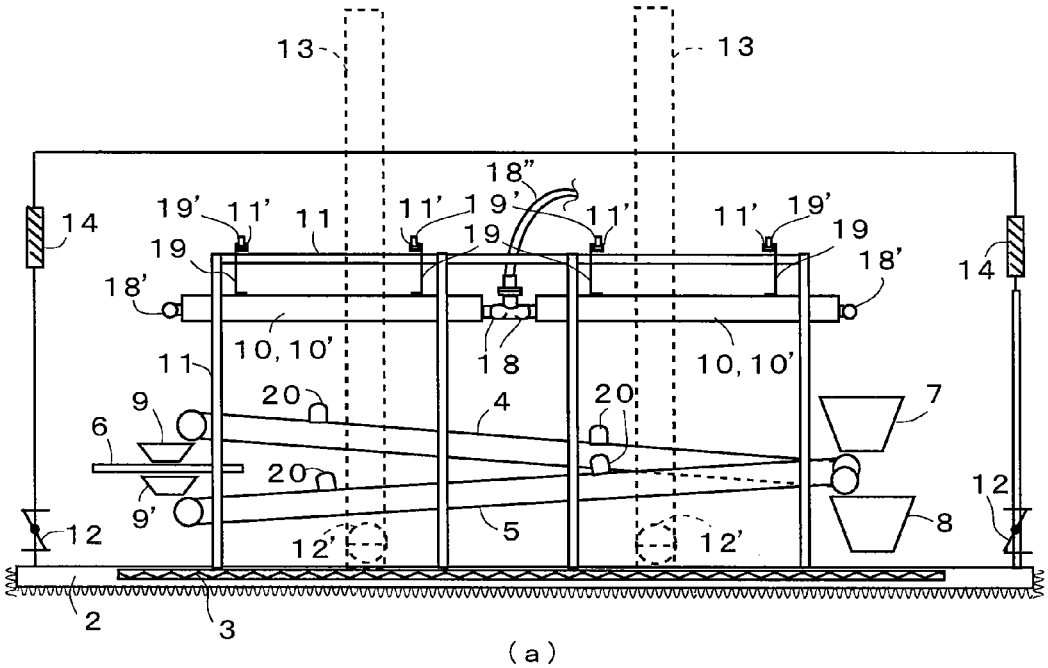
FIG. 3(*a*) is side view of all weather passive-type solar Ogako drying house including the inside equipped components FIG. 3(*b*) is plan view of all weather passive-type solar Ogako drying house including the inside equipped components FIG. 4(*a*) is an inner plan viewed from bottom of detailed top radiation panel FIG. 4(*b*) is A-A cross-sectional and side views of FIG. 4(*a*)
Figure 3:
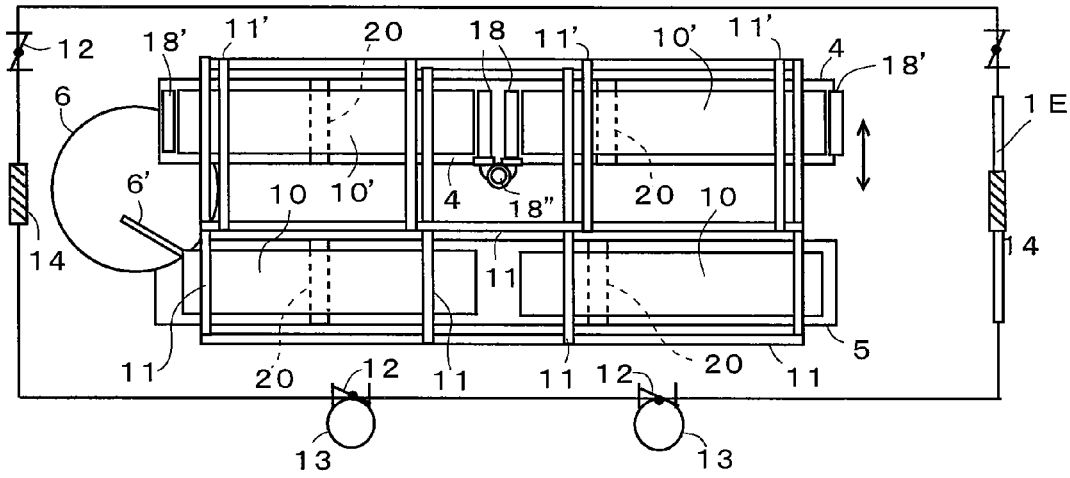

FIG. 3 shows a support frame 11, a hanger slide rail 11' and the scheme 10" when sliding the slide-type top radiation panel 10' over the go-ahead conveyor 4. As shown in a left side view of FIG. 3(*a*) and a plan view of FIG. 3(*b*), the slide-type top radiation panel 10' is hung from a hanger slide rail 11' held by a support frame 11 which frames over the go-ahead conveyor 4 and go-back conveyor 5, the slide-type top radiation panel 10' is hung from the hanger slide rail 11', as to be able to slide in north-south direction through hanger jig and hanger roller, and the fixed-type top radiation panel 10 is hung always rigidly from the support frame 11.

Two of the top radiation panels 10, 10' are arranged over every belt-conveyor of the go-ahead conveyor 4 and go-back conveyor 5 installed in east-west direction, and have an inlet header 18 on the feed side, four steam pipes 17 on the radiation plate 16 and an outlet steam header 18' on the return side each, through which steam of high temperature flows.

Around the top radiation panel, steam of 150° C. is supplied from a steam boiler (not shown in FIGs) to the inlet header 18 through a flexible steam pipe 18", from the inlet header 18 to the steam pips 17 and then recovered into the outlet header 18', after that the steam is returned to hot water boiler through another flexible steam pipe.

Figure 4:
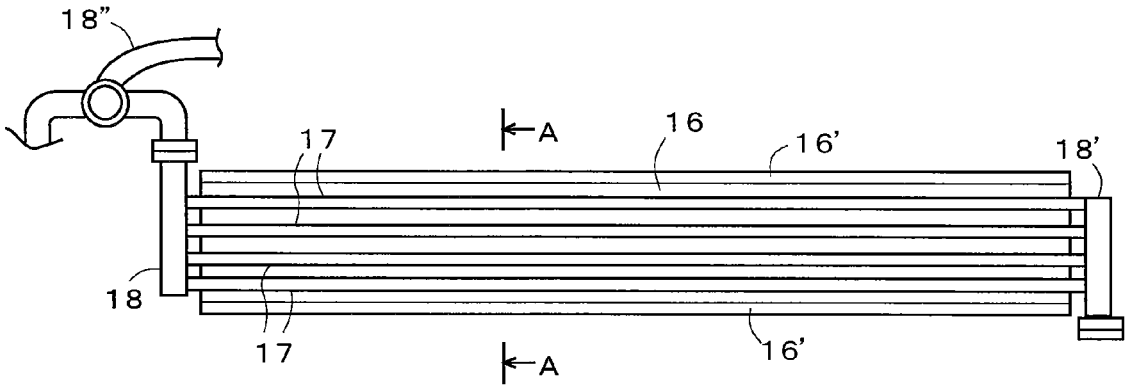
Figure 4:
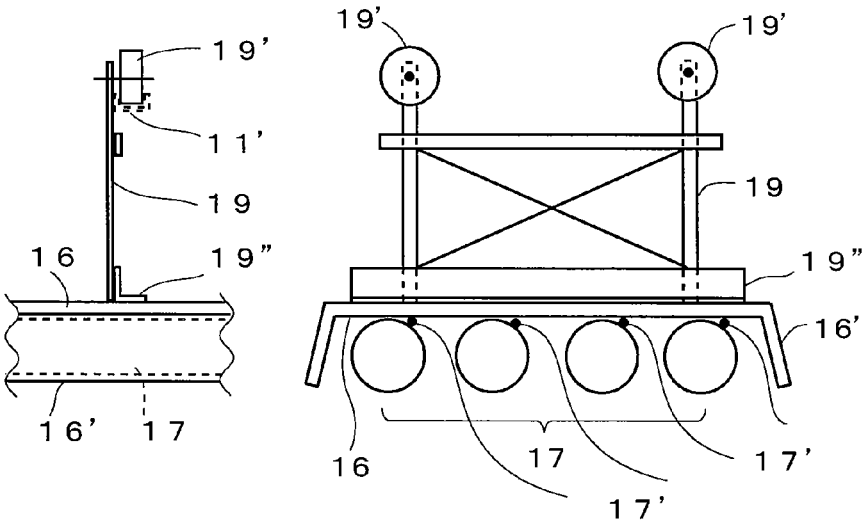

To power up the system capacity for the use in night, the top radiation panel on which steam pipe is increased from two to four is shown in FIG. 4. As shown in FIG. 4(*a*) an inner plan viewed from bottom, and FIG. 4(*b*) A-A line cross-sectional view and the side view, four steam pipes 17 are welded by means of spot welding 17' on a radiation panel plate 16 in parallel, which is hung by a hanger jig 19 and a hanger roller 19' from the hanger slide rail 11'. An angle bar 19" is welded between a radiation panel plate 16 and a hanger jig 19 to connect both and reinforce enforce the radiation panel plate 16.

Inner surface of the radiation panel plate 16 with fin plate 16' is coated in black as to increase thermal radiation from which, to be able to dry out Ogako even in night and on heavy cloudy day.

Figure 5:
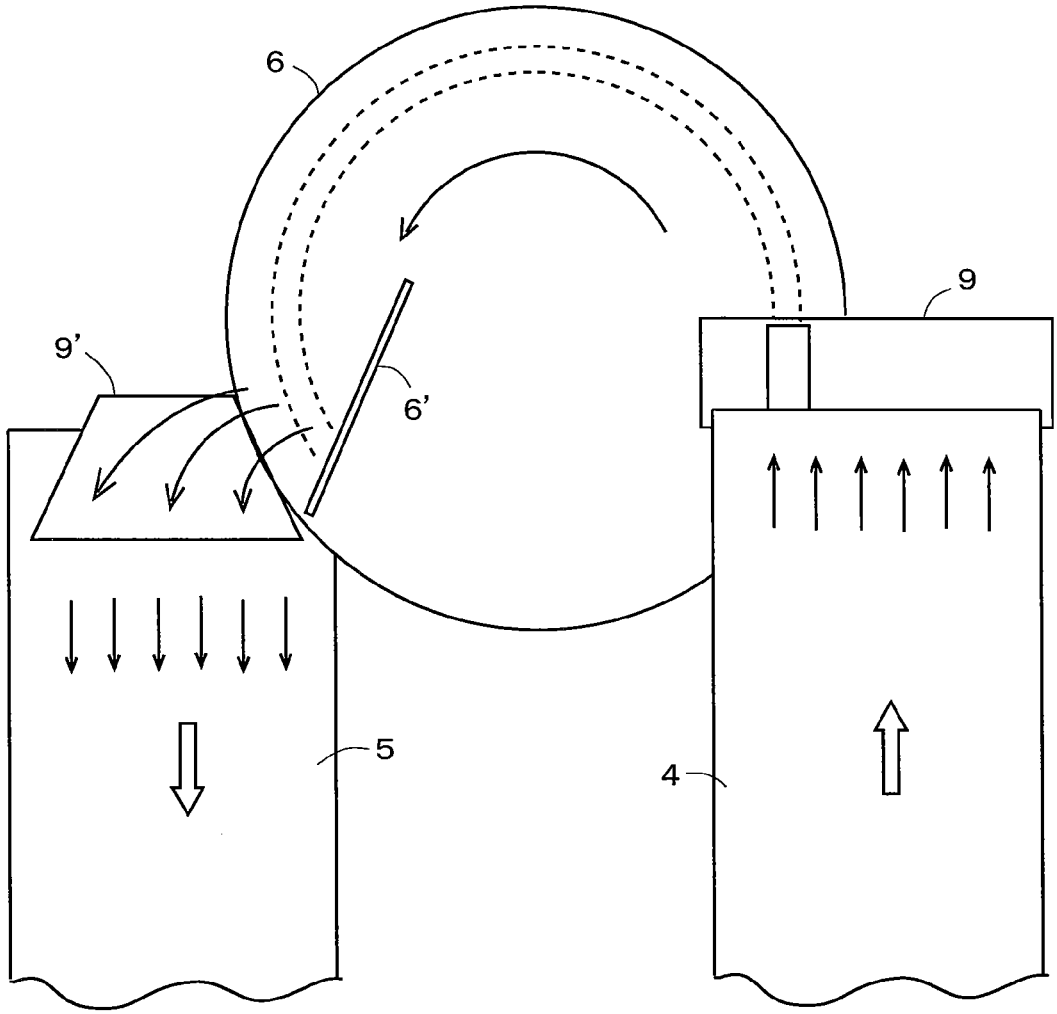
FIG. 5 Enlarged plan view of the turn-back table with surroundings
Figure 6:
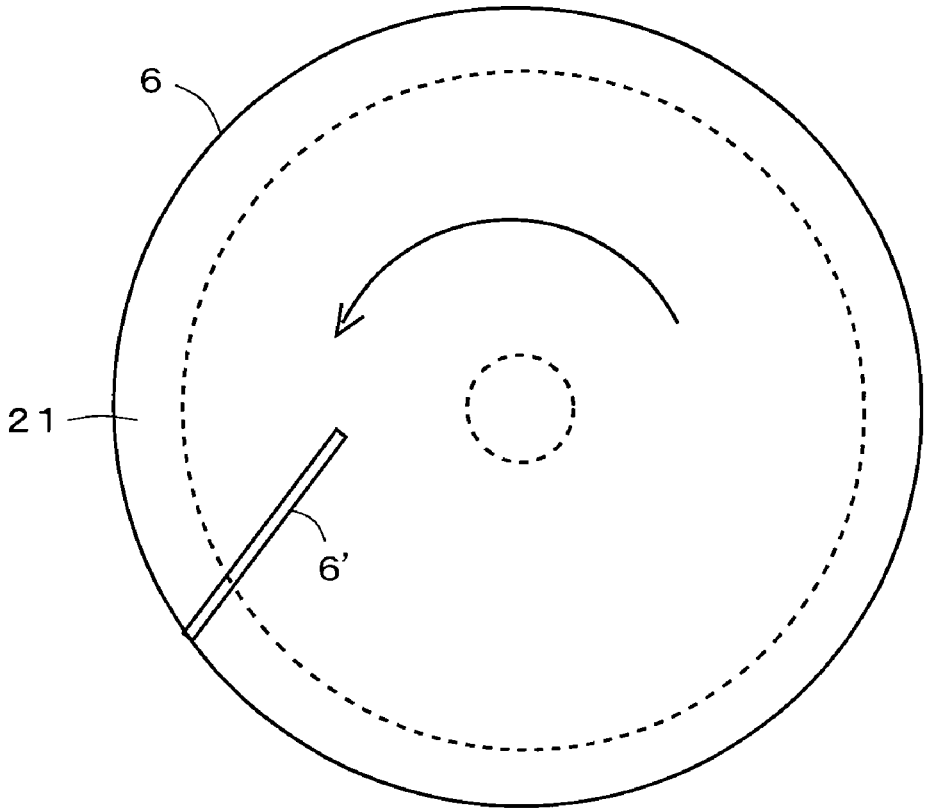
FIG. 6(*a*) is plan of the turn-back table
Figure 6:
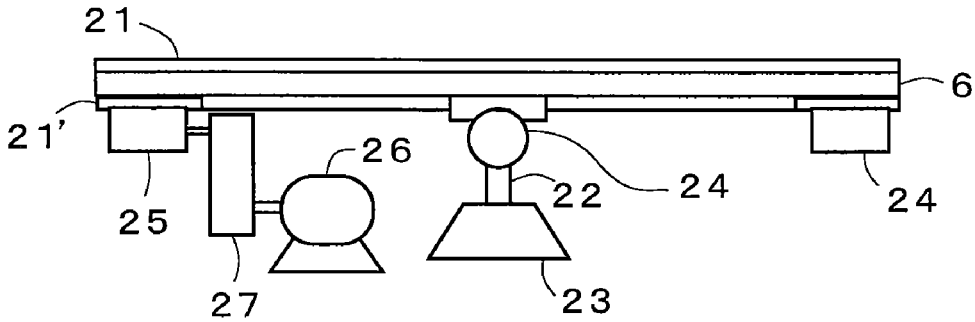

A turn-back table 6 with surroundings and details of the turn-back table 6 are shown in an enlarged plan of FIG. 5 and in a plan view of FIG. 6(*a*) and a side view of FIG. 6(*b*), a circular rotating table 6 composed of compiled wood panel and a circular gum sheet 21 is held freely around a vertical rotation axis 22 with a rotational bearing 23. A gum ring plate 21' is fixed adhesively on periphery of under surface of the circular rotating table 6 at which the table is supported by four rollers 24, 25. Three idle rollers 24 of which support the table and a driving roller 25 of which drives the table in contact with the gum ring plate 21' through a reduction gear 27 by a electric motor 26. The turn-back table 6 is rotated slowly counterclockwise by means of the driving roller 25 drived by the electric motor 26 through the reduction gear 27. As shown in the FIG. 5, a half dried Ogako on the turn-back table 6 fed from the go-ahead conveyor 4 through a saucer shoot 9 is transferred through another saucer-plate 9' to the go-back conveyor 5.

A half dried Ogako is raked off by a scraper 6' to another saucer-plate 9' at start point of the go-back conveyor 5, and transferred on the go-back conveyor 5 with uniform thickness. After the half dried Ogako on the go-back conveyor 5 was fully dried absorbing radiation from a top radiation panel 10, it can be recovered into a receive hopper 8 at end point of the go-back conveyor 5 as the production of fully dried Ogako.

Figure 7:
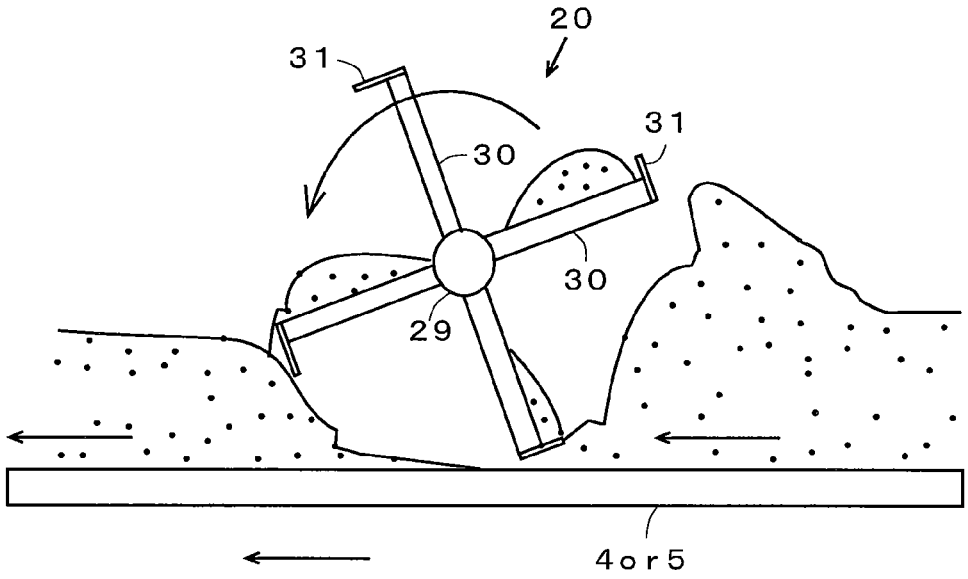
FIG. 7(*a*) Side view of the rotational mixing scraper
Figure 7:
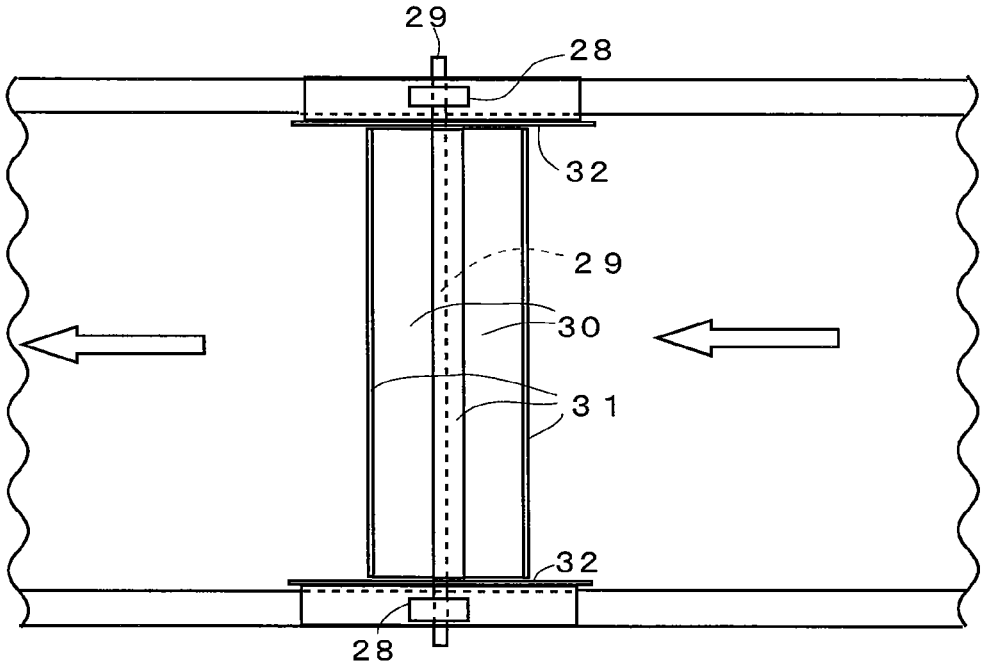

Details of a rotational mixing scraper 20 are shown in FIG. 7. As shown in side view of FIG. 7(*a*) and plan of FIG. 7(*b*), the rotational mixing scraper 20 which is held freely by two bearings 28 through a rotational axis 29, is set on bridging the side frame of the go-ahead conveyor 4 and go-back conveyor 5, on which four of the blade 30 extended to radial direction from the rotational axis 29 and the same number of nails 31 as above fixed in opposite to the progress direction of the conveyors.

When Ogako is carried on the go-ahead conveyor 4 and go-back conveyor 5, the rotational mixing scraper 20 can be attached on as two sets a 10 m conveyor each, and rotated oppositely to progressing direction of both conveyors 4, 5, so that mixing and drying of Ogako are well done. Namely, the approaching-Ogako is scraped up by a nail 31 fixed on the blade of rotational mixing scraper 20, and put it on the blade surface, after passing a top dead center the Ogako is dropped on a rear surface of the forward blade due to its own gravity, and when rotating moreover the Ogako is transferred into the go-ahead conveyor 4 or go-back conveyor 5 as the going away-Ogako with mixing action. Besides, a guide plate 32 is set up to prevent scattering of Ogako from side frames of both conveyors 4, 5 when the rotational mixing scraper 20 works.

According to the attached FIGs, the operational and working methods on the all weather passive-type solar Ogako drying house H are explained as follows:

In daytime, a supply hopper 7 is placed at start point of a go-ahead conveyor 4 and a receive hopper 8 is placed at end point of a go-back conveyor 5, and raw Ogako is fed on the go-ahead conveyor 4 moving slow with uniform thickness from an outlet of the supply hopper 7, so that raw Ogako is dried absorbing direct solar radiation R transmitted through a double transparent film 1 such a scheme 10" as the top radiation panel 10' slid in north side of the house.

A saucer shoot 9 is set on the end point of the go-ahead conveyor 4, and Ogako is transferred into a turn-back table 6 after received in the saucer shoot 9 once. The turn-back table 6 which is rotated slow counterclockwise receives as half dried Ogako from the go-ahead conveyor 4, then half dried Ogako is raked off by a scraper 6' to a saucer plate 9' and fed to the go-back conveyor 5 with uniform thickness again. The half-dried Ogako is fully dried due to radiation from a fixed-type top radiation panel 10 over the go-back conveyor 5 and recovered into a receive hopper 8 at the end point of which as fully dried Ogako.

During Ogako carrying on both conveyors 4, 5, Ogako is mixed to accelerate the drying effect by means of a rotational mixing scraper 20, each conveyor 4, 5 can be set up two sets of the rotational mixing scraper 20. For this period in daytime, and during Ogako being carried on the go-ahead conveyor 4 and go-back conveyor 5, the Ogako is also dried by the convection owing to circulation of hot and low moist air inside the house by means of four small fans 15.

While in night or on heavy cloudy day, inside air is warmed up due to radiation and convection by means of the top radiation panels 10, 10' and a floor heater 3 molded in the concrete floor 2 heated with an auxiliary boiler (out of Figs) to keep around 40° C. or so in the house H, and then raw Ogako on the go-ahead conveyor 4 is dried by means of a sliding-type top radiation panel 10' pulled back in proper position of south side over which, and also half dried Ogako on a go-back conveyor 5 is dried by means of a fixed-type top radiation panel 10 over which by supplying high temperature steam (150° C.) from an auxiliary boiler respectively.

What is claimed are:

1. An all weather passive-type solar Ogako drying house improving an agricultural vinyl-house shaped as a Quonset hut is comprised of:

a roof and walls of the house made of a double transparent film and a shading sheet, a floor of the house made of concrete, a floor heater molded in floor, two lines of belt conveyors installed in parallel with each other along depth direction, one of which is a go-ahead conveyor and the other is a go-back conveyor, a turn-back table connecting both the conveyors set up at the start point of the go-back conveyor, a supply hopper set on over the go-ahead conveyors and at start point, the west side end, of the go-ahead conveyors, a receive hopper set on under the end of go-back conveyor and lower level than that of the supply hopper, at end point, the west side end, of go-back conveyor, a saucer-shoot set on the end point of the go-ahead conveyor to receive Ogako from the conveyor, a saucer-plate set on the start point of the go-back conveyor to transfer Ogako to the go-back conveyor, a scraper on the turn-back table set up at the start point of the go-back conveyor to rake off Ogako from the turn-back table to saucer-plate, a fixed-type top radiation panel and a slide-type top radiation panel, which is able to slide to north side from south side of the house, hung on over the go-ahead and go-back conveyors respectively, besides, two insulated cylinders with take-out damper duct are settled in vertical north surface outside the house in which draft force is available.

2. All weather passive-type solar drying house according to claim 1, the shading sheet is opened to collect the solar energy in daytime and closed to obstruct heat loss in night by means of windlass spread up inside the double transparent film of the house.

3. All weather passive-type solar drying house according to claim 1, further comprising rotational mixing scrapers held freely by two bearings through a rotational axis which are provided on both sides of the go-ahead conveyor and the go-back conveyor, are set on bridging the side frame of the go-ahead conveyor and go-back conveyor respectively.

* * * * *